US010219336B2

(12) United States Patent
Mun et al.

(10) Patent No.: US 10,219,336 B2
(45) Date of Patent: Feb. 26, 2019

(54) LED LIGHTING APPARATUS

(71) Applicant: SILICON WORKS CO., LTD., Daejeon-si (KR)

(72) Inventors: Gyeong Sik Mun, Sejong-si (KR); Ki Soo Kwon, Daejeon-si (KR)

(73) Assignee: SILICON WORKS CO., LTD., Daejeon-si (KR)

( * ) Notice: Subject to any disclaimer, the term of this patent is extended or adjusted under 35 U.S.C. 154(b) by 0 days.

(21) Appl. No.: 15/992,463

(22) Filed: May 30, 2018

(65) Prior Publication Data

US 2018/0368226 A1 Dec. 20, 2018

(30) Foreign Application Priority Data

Jun. 15, 2017 (KR) ..... 10-2017-0075664

(51) Int. Cl.
*H05B 37/00* (2006.01)
*H05B 33/08* (2006.01)

(52) U.S. Cl.
CPC ..... *H05B 33/0815* (2013.01)

(58) Field of Classification Search
CPC ..... H05B 33/0815
USPC ..... 315/201
See application file for complete search history.

(56) References Cited

U.S. PATENT DOCUMENTS 9,107,262 B2 8/2015 Jung
9,380,657 B2 6/2016 Akiyama et al.
9,775,204 B2 * 9/2017 Kang, Il ..... H05B 33/083
2011/0109244 A1 * 5/2011 Grajcar ..... H05B 33/0827 315/294
2012/0229030 A1 * 9/2012 Moskowitz ..... H05B 33/0809 315/122
2015/0173150 A1 * 6/2015 Kim ..... H05B 33/0824 315/188
2016/0014860 A1 * 1/2016 Yoo ..... H05B 33/0824 315/191
2016/0050730 A1 * 2/2016 Kim ..... H05B 33/0812 315/191
2016/0150607 A1 * 5/2016 Kim ..... H05B 33/0815 315/210
2017/0048947 A1 * 2/2017 Kim ..... H05B 33/083
2017/0064781 A1 * 3/2017 Haskvitz ..... H05B 33/083
2017/0150560 A1 * 5/2017 Janning ..... H05B 33/089
2017/0290111 A1 * 10/2017 Akiyama ..... H05B 37/02
2018/0027624 A1 * 1/2018 Kim ..... H05B 33/0824 315/297
2018/0116021 A1 * 4/2018 Jin ..... F28F 3/022

FOREIGN PATENT DOCUMENTS

KR 10-1311775 9/2013
KR 10-2013-0117133 10/2013

* cited by examiner

*Primary Examiner* — Don Le

(74) *Attorney, Agent, or Firm* — Kile Park Reed & Houtteman PLLC

(57) ABSTRACT

Disclosed is an LED lighting apparatus which includes LED groups and emits light in response to a change of a rectified voltage. The LED lighting apparatus includes a balancing circuit which controls the rectified voltage to be applied to the LED groups in parallel or series to each other.

20 Claims, 5 Drawing Sheets

LED LIGHTING APPARATUS

BACKGROUND

1. Technical Field

The present disclosure relates to an LED lighting apparatus, and more particularly, to an LED lighting apparatus which includes LED groups and emits light in response to a change of a rectified voltage.

2. Related Art

A lighting apparatus is designed to use a light source which exhibits high light emission efficiency using a small amount of energy, in order to reduce energy consumption. Representative examples of a light source used in the lighting apparatus may include an LED.

The LED is differentiated from other light sources in terms of various aspects such as energy consumption, lifetime, and light quality. Since the LED is driven by a current, the lighting apparatus using the LED as a light source requires many additional circuits for current driving.

In order to solve the above-described problem, an AC direct-type lighting apparatus has been developed.

The AC direct-type lighting apparatus (hereafter, referred to as "LED lighting apparatus") converts an AC voltage into a rectified voltage, and drives a current using the rectified voltage, thereby causing an LED to emit light. Since the LED lighting apparatus directly uses the rectified voltage without using an inductor and capacitor, the LED lighting apparatus has a satisfactory power factor. The rectified voltage indicates a voltage obtained by full-wave rectifying an AC voltage through a rectifier.

The LED lighting apparatus includes LEDs divided into a plurality of LED groups which sequentially emit light in response to changes of the rectified voltage.

In this case, the LED groups may have different numbers of LEDs or different light emission voltages, thereby having a difference in illumination therebetween. Therefore, the LED groups of the conventional LED lighting apparatus may have uneven illumination.

Since the LED groups of the LED lighting apparatus sequentially emit light, the respective LED groups are used for light emission at different times. That is, the usage rates of the LEDs in the respective LED groups may be different from each other. Therefore, the LEDs of the conventional LED lighting apparatus may be used at low usage rates.

The LED lighting apparatus may employ a dimmer for implementing a dimming function.

The dimmer may output an AC voltage of which the phase angle is controlled, the LED lighting apparatus may generate a rectified voltage using the phase angle-controlled AC voltage, and a light source including the LEDs emits light in response to the phase angle-controlled rectified voltage.

The brightness of the LED lighting apparatus may be adjusted as the phase angle of the rectified voltage is controlled between the maximum value and a dimming-off level for turn-off by the dimmer.

However, the dimmer may have a non-linear operation characteristic. Thus, the LED lighting apparatus may have uneven illumination.

The dimmer needs a holding current for a stable operation in response to the rectified voltage equal to or less than the dimming-off level.

However, when the rectified voltage is controlled to less than the dimming-off level for turn-off by the dimmer, the holding current of the dimmer may flow through a part of the LEDs of the light source.

Although the rectified voltage was controlled to less than the dimming-off level for turning off the light source, the LED lighting apparatus may emit weak light when the holding current flows through a part of the LEDs.

The phenomenon that a part of the LEDs of the light source is undesirably turned on by the holding current of the dimmer and thus emits weak light may reduce the reliability of the LED lighting apparatus.

SUMMARY

Various embodiments are directed to an LED lighting apparatus capable of reducing a difference in illumination between LED groups and improving the usage rates and lifetimes of LEDs included in the LED groups.

Also, various embodiments are directed to an LED lighting apparatus capable of removing uneven illumination which may occur depending on whether a dimmer is employed, thereby realizing uniform dimming.

Also, various embodiments are directed to an LED lighting apparatus capable of blocking a holding current flowing to LEDs when a rectified voltage is controlled to a level for turn-off by a dimmer, thereby preventing a part of LEDs from emitting weak light through a holding current.

In an embodiment, an LED lighting apparatus may include: a rectifier circuit configured to output a rectified voltage; a channel unit configured to provide a discharge current to an output terminal of the rectifier circuit when the rectified voltage is equal to or higher than a first level; a first LED group connected to the rectifier circuit, and configured to emit light in response to the rectified voltage equal to or more than a second level which is higher than the first level; a balancing resistor connected to an output terminal of the first LED group; a balancing circuit configured to form a balancing path between the rectifier circuit and the balancing resistor and perform first regulation on a current of the balancing path, in response to the rectified voltage less than a third level which is higher than the second level; a second LED group connected to the balancing resistor, and configured to emit light in response to the rectified voltage applied through any one of the balancing path and the first LED group; a driver configured to selectively provide a current path for the turned-on first and second LED groups and the discharge path of the channel unit by comparing a sensing voltage and an internal reference voltage; and a sensing resistor configured to sense a driving current outputted from the driver through the current path, and provide the sensing voltage.

DETAILED DESCRIPTION

Figure 1:
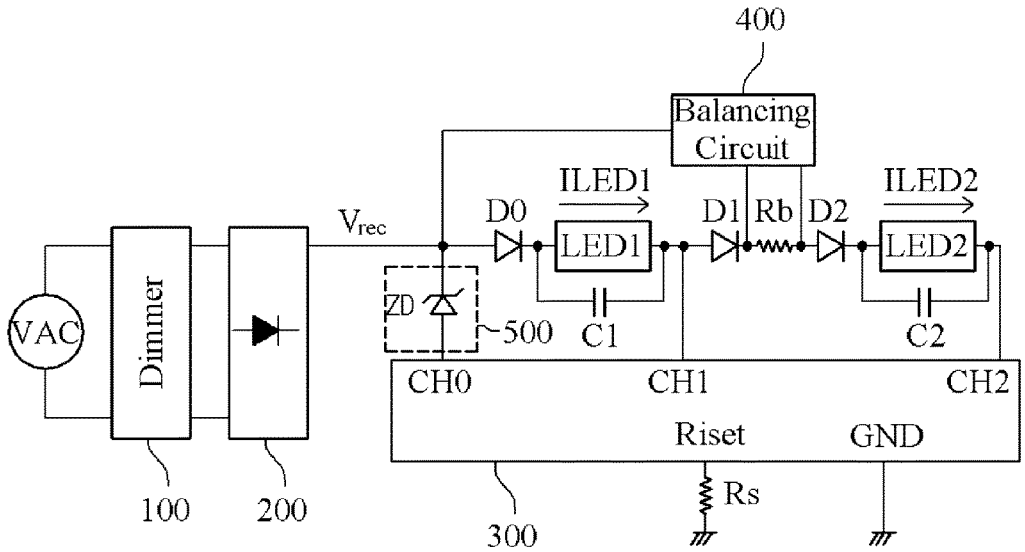
FIG. 1 is a circuit diagram illustrating an LED lighting apparatus according to an embodiment of the present invention.

Hereafter, embodiments of the present invention will be described in detail with reference to the accompanying drawings. The terms used in the present specification and claims are not limited to typical dictionary definitions, but must be interpreted as meanings and concepts which coincide with the technical idea of the present invention.

Embodiments described in the present specification and configurations illustrated in the drawings are preferred embodiments of the present invention, and do not represent the entire technical idea of the present invention. Thus, various equivalents and modifications capable of replacing the embodiments and configurations may be provided at the point of time that the present application is filed.

An LED lighting apparatus according to an embodiment of the present invention may include a light source having a semiconductor light emitting characteristic to convert electrical energy into light energy, and the light source having a semiconductor light emitting characteristic may include an LED.

The LED lighting apparatus according to the embodiment of the present invention may be implemented with an AC direct type lighting apparatus. The AC direct type LED lighting apparatus controls an LED to emit light using a rectified voltage Vrec obtained by converting an AC voltage.

The rectified voltage Vrec has a waveform obtained by full-wave rectifying an AC voltage having a sine wave. That is, the rectified voltage Vrec has a ripple in which the voltage level rises/falls by the half cycle of a common AC voltage.

As illustrated in FIG. 1, the LED lighting apparatus according to the embodiment of the present invention includes a dimmer 100, a rectifier circuit 200, LED groups LED1 and LED2, a balancing resistor Rb, a driver 300, a balancing circuit 400 and a channel unit 500.

The dimmer 100 decides a position at which the phase angle of an AC voltage provided from an AC power supply VAC is triggered in response to a change of an internal charging voltage, in order to control the phase angle of the AC voltage. That is, the dimmer 100 outputs a phase angle-controlled AC voltage. The AC power supply VAC may include a commercial power supply.

The rectifier circuit 200 full-wave rectifies the AC voltage of which the phase angle is controlled by the dimmer 100, and outputs the rectified voltage Vrec. In the present embodiment, a rise or fall of the rectified voltage Vrec may be understood as a rise or fall in ripple of the rectified voltage Vrec.

The channel unit 500 is installed at an output terminal of the rectifier circuit 200. The channel unit 500 receives the rectified voltage Vrec outputted from the rectifier circuit 200, and provides a discharge path to the output terminal of the rectifier circuit 200 when the rectified voltage Vrec is equal to or more than a first level.

In order to provide the discharge path, the channel unit 500 is connected to the output terminal of the rectifier circuit 200 in parallel to the LED group LED1, and includes a Zener diode ZD.

The Zener diode ZD serves as a constant voltage source to which a first-level constant voltage is biased, and electricity is conducted when a voltage equal to or more than the first level is applied across the Zener diode ZD. Therefore, when the rectified voltage Vrec rises over the first level, the channel unit 500 provides a discharge current for a holding current through electrical conduction of the Zener diode ZD.

The first-level voltage may be set based on a second-level voltage at which the LED group LED1 can emit light. In the present embodiment, the first-level voltage is set to 60% of the second-level voltage.

According to the above-described configuration, the channel unit 500 provides a discharge path for the rectified voltage Vrec equal to or more than the first level, and blocks a current from flowing to the LED group LED1 or the balancing circuit 400. The current flowing through the discharge current of the channel unit 500 may be discharged through a current path of the driver 300 which will be described later.

According to the above-described configuration, the channel unit 500 can discharge a holding current through the dimmer 100, the holding current being caused by the rectified voltage Vrec equal to or higher than the first level and lower than the second level. Therefore, when the rectified voltage Vrec is controlled to a dimming-off level or less, a part of the LEDs can be prevented from emitting weak light using the holding current. The second level may be defined as a voltage level at which both of the LED groups LED1 and LED2 emit light.

In the present embodiment, the LED lighting apparatus includes two LED groups LED1 and LED2, for convenience of description. The LED groups LED1 and LED2 include one or more LEDs, and are connected in series to each other through the balancing resistor Rb.

The LED groups LED1 and LED2 may be configured to emit light when a voltage equal to or higher than the second level higher than the first level is applied across the LED groups LED1 and LED2.

In the present embodiment, the LED group LED1 is connected to the rectifier circuit 200, and emits light in response to the rectified voltage Vrec equal to or higher than the second level.

The LED group LED2 is connected to the balancing resistor Rb, and emits light in response to the rectified voltage Vrec applied through any one of the LED group LED1 and the balancing path of the balancing circuit 400. The LED group LED2 may be configured to emit light in response to a voltage equal or higher than the second level.

The LED lighting apparatus may further include a capacitor C1 installed in parallel to the LED group LED1 and a capacitor C2 installed in parallel to the LED group LED2. The capacitors C1 and C2 serve to reduce flicker, and are charged and discharged to gently change a current flowing through the LED groups LED1 and LED2.

The LED lighting apparatus may further include diodes D0 and D1 installed at the input and output terminals of the LED group LED1, respectively, and a diode D2 installed at the input terminal of the LED group LED2, in order to block a reverse current.

The balancing resistor Rb is installed between the diode D1 positioned at the output terminal of the LED group LED1 and the diode D2 positioned at the input terminal of the LED group LED2.

The balancing circuit 400 is connected to the output terminal of the rectifier circuit 200 in parallel to the LED group LED1, and configured to sense a balancing voltage across the balancing resistor Rb. According to the above-described configuration, the balancing circuit 400 forms a balancing path between the rectifier circuit 200 and the balancing resistor Rb and regulates a current on the balancing path, in response to the rectified voltage Vrec equal to or higher than the second level and lower than a third level. The third level is higher than the second level.

The driver 300 has channels CH0, CH1 and CH2, a sensing resistor terminal Riset and a ground terminal GND, compares a sensing voltage to an internal reference voltage, and selectively provides a discharge path of the channel unit 500 and a current path for the turned-on LED group LED1 and the turned-on LED group LED2.

The channel CH0 of the driver 300 is connected to the discharge path of the channel unit 500, the channel CH1 of the driver 300 is connected to the output terminal of the LED group LED1, and the channel CH2 of the driver 300 is connected to the output terminal of the LED group LED2.

Figure 3:
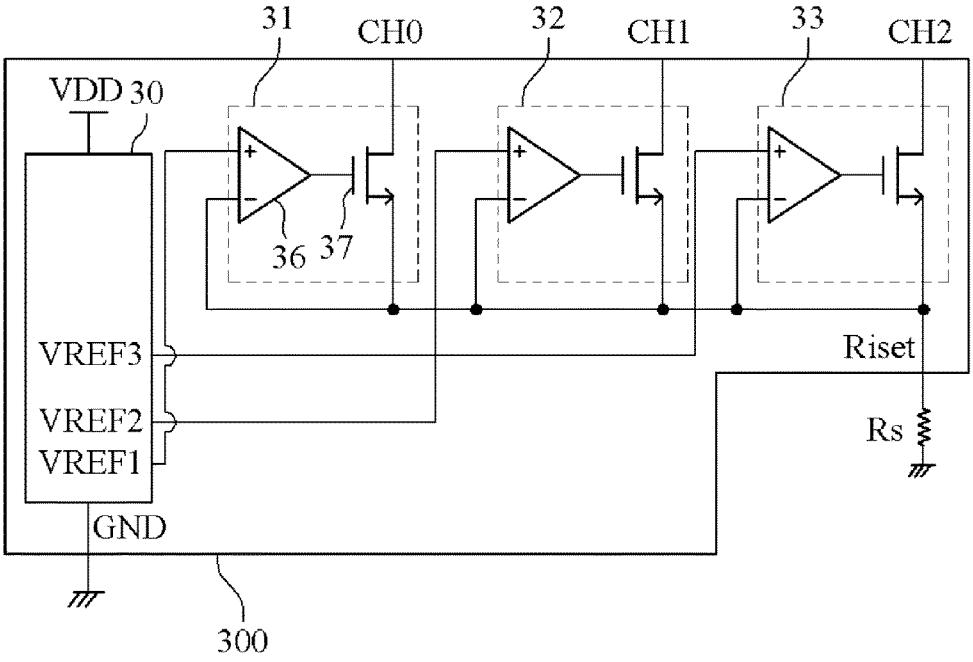
FIG. 3 is a detailed circuit diagram of a driver of FIG. 1.

The detailed configuration of the driver 300 will be described later with reference to FIG. 3.

The sensing resistor Rs is connected to a current path of the driver 300 through the sensing resistor terminal Riset, and configured to sense a current outputted from the driver 300 through the current path and provide a sensing voltage. The sensing resistor Rs may be installed between the driver 300 and the ground.

The detailed configurations of the balancing circuit 400 and the LED groups LED1 and LED2 will be described with reference to FIG. 2.

Figure 2:
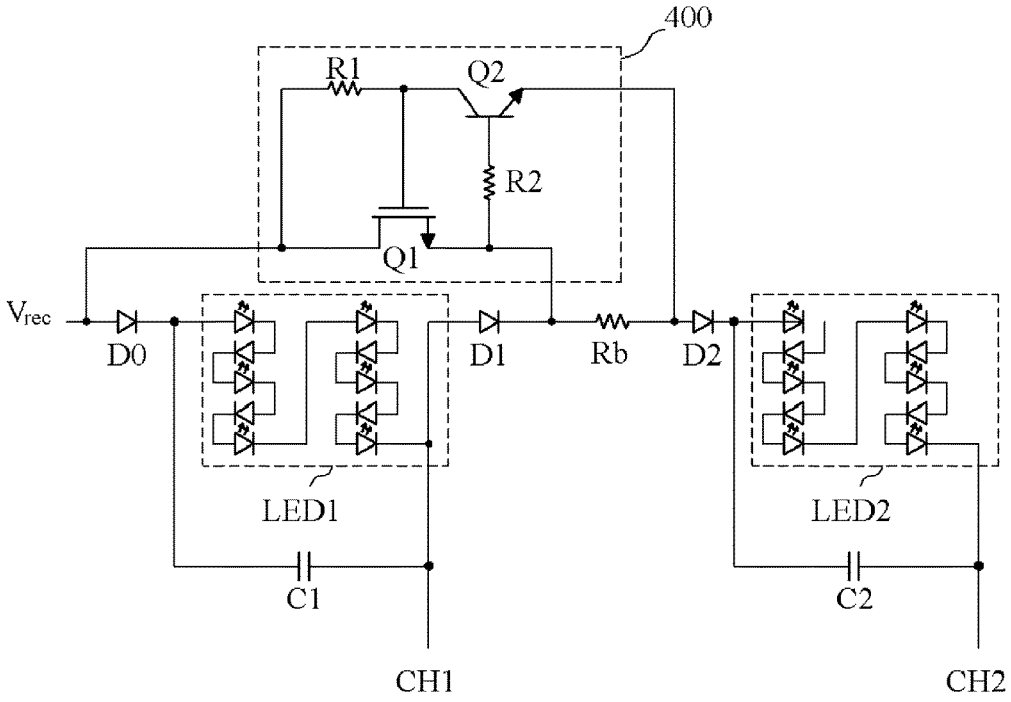
FIG. 2 is a detailed circuit diagram of a balancing circuit and LED groups in FIG. 1.

FIG. 2 illustrates that each of the LED groups LED1 and LED2 includes eight LEDs connected in series. The number of LEDs included in each of the LED groups LED1 and LED2 may be set to various values by a designer.

The balancing circuit 400 may include a first transistor Q1 for providing a balancing path and a second transistor Q2 for controlling the current regulation on the balancing path and the formation of the balancing path. The first transistor Q1 may include an NMOS transistor, and the second transistor Q2 may include an NPN bipolar transistor.

In the balancing circuit 400, the first transistor Q1 has a drain connected to the output terminal of the rectifier circuit 200 for providing the rectified voltage Vrec, a source connected to a node between the diode dl and the balancing resistor Rb, and a gate connected to the output terminal of the rectifier circuit 200 through the resistor R1.

In the balancing circuit 400, the second transistor Q2 has a collector connected to a node between the resistor R1 and the gate of the first transistor Q1, a base connected to a node between the source of the first transistor Q1 and the balancing resistor Rb through the resistor R2, and an emitter connected to a node between the balancing resistor Rb and the diode D2.

The balancing circuit 400 provides the balancing path for the rectified voltage Vrec equal to or higher than the second level at which the LED group LED1 emits light, and blocks the balancing path from the rectified voltage Vrec equal to or higher than the third level. That is, the balancing path is provided in response to the rectified voltage Vrec which is equal or to higher than the second level and lower than the third level. The current of the balancing path is regulated.

For this configuration, the resistance values of the resistors R1 and R2 may be set to such an extent that the first transistor Q1 can be turned off by current control of the second transistor Q2 when the rectified voltage Vrec reaches the third level.

The balancing resistor Rb senses a current supplied to the LED group LED2. The resistance value of the balancing resistor Rb is set to regulate the current supplied to the LED group LED2 through the balancing path, that is, the first transistor Q1. In the present embodiment, the balancing resistor Rb regulates the current supplied to the LED group LED2 in response to the rectified voltage Vrec equal to or higher than the second level, and provides a balancing voltage for adjusting a balance in current between the LED groups LED1 and LED2.

The resistance value of the balancing resistor Rb to provide the balancing voltage may be set to such an extent that the level of a current regulated by the balancing circuit 400 is equal to the level of a current regulated by a switching circuit 32 of the driver 300. When the resistance value of the balancing resistor Rb is set, the LED groups LED1 and LED2 can emit light at the same brightness using the same amount of current, in response to the rectified voltage Vrec equal to or higher than the second level and lower than the third level. In the above-described configuration, the first transistor Q1 is turned on by the rectified voltage Vrec when a drain-gate voltage thereof corresponds to a turn-on condition.

When the rectified voltage Vrec is lower than the second level, the input current outputted from the rectifier circuit 200 is discharged to the discharge path of the channel unit 500. Therefore, when the rectified voltage Vrec is lower than the second level, the input current outputted from the rectifier circuit 200 is not transferred to the first transistor Q1.

When the rectified voltage Vrec rises over the second level, a current corresponding to the input current outputted from the rectifier circuit 200 is transferred to the LED group LED2 through the balancing resistor Rb and the balancing path by the first transistor Q1.

At this time, the balancing voltage of the balancing resistor Rb acts between the emitter and base of the second transistor Q2, and the first transistor Q1 is controlled to pass a current regulated through the balancing path, according to control of the second transistor Q2.

When the rectified voltage Vrec rises over the third level, the gate voltage of the first transistor Q1 is lowered to a turn-off level by the second transistor Q2. As a result, the first transistor Q1 is turned off, and the balancing path is blocked.

That is, the balancing circuit 400 provides a balancing path which bypasses the LED group LED1 and transfers a current to the LED group LED2 in response to the rectified voltage Vrec equal to or higher than the second level and lower than the third level, the current being obtained by rectifying the input current Irec of the rectifier circuit 200.

Therefore, when the rectified voltage Vrec is equal to or higher than the second level and lower than the third level, the LED groups LED1 and LED2 are connected in parallel to the rectifier circuit 200 by the formation of the balancing path, and the rectified voltage Vrec having the same level is applied to the LED groups LED1 and LED2.

That is, the LED groups LED1 and LED2 emit light at the same time when the second-level rectified voltage Vrec is applied, and maintains the light emission using the regulated current while the rectified voltage Vrec rises from the second level to the third level. At this time, the input current provided to the LED group LED1 may be regulated by the driver 300 described later.

The detailed configuration and regulation operation of the driver 300 will be described with reference to FIG. 3.

The driver 300 includes switching circuits 31 to 33 and a reference voltage supply unit 30 for providing reference voltages VREF1 to VREF3.

The channel unit 500 is connected to the switching circuit 31 through the channel terminal CH0 of the driver 300. The output terminal of the LED group LED1 is connected to the switching circuit 32 through the channel terminal CH1 of the driver 300. The output terminal of the LED group LED2 is connected to the switching circuit 33 through the channel terminal CH2 of the driver 300.

The reference voltage supply unit 30 may be configured to provide the reference voltages VREF1 to VREF3 having different levels, depending on a designer's intention.

The reference voltage supply unit 30 may include a plurality of resistors connected in series to receive a constant voltage VDD, for example, and output the reference voltage VREF1 to VREF3 having different levels to nodes between the respective resistors.

Unlike the above-described configuration, the reference voltage supply unit 30 may include independent voltage supply sources for providing the reference voltages VREF1 to VREF3 having different levels, respectively.

The reference voltage supply unit 30 is connected to the ground terminal GND while sharing the ground.

Among the reference voltages VREF1 to VREF3 having different levels, the reference voltage VREF1 may have the lowest voltage level, and the reference voltage VREF3 may have the highest voltage. The voltage levels of the reference voltages VREF1 to VREF3 may have a relation of VREF1>VREF2>VREF3.

The reference voltage VREF1 has a level for turning off the switching circuit 31 because the reference voltage VREF1 is lower than the sensing voltage of the sensing resistor Rs at a point of time that the LED group LED1 emits light.

The reference voltage VREF2 has a level for turning off the switching circuit 32 because the reference voltage VREF2 is lower than the sensing voltage of the sensing resistor Rs at a point of time that the LED group LED2 emits light.

The reference voltage VREF3 has a level equal to or higher than the sensing voltage of the sensing resistor Rs, corresponding to the peak level of the rectified voltage Vrec.

The switching circuits 31 to 33 are connected to the sensing resistor Rs in common through the sensing terminal Riset, in order to perform current regulation and to form a current path.

The switching circuits 31 to 33 compare the sensing voltage of the sensing resistor Rs to the reference voltages VREF1 to VREF3 of the reference voltage supply unit 30, and form a discharge path of the channel unit 500 and a current path corresponding to light emission of the LED groups LED1 and LED2.

Each of the switching circuits 31 to 33 receives a high-level reference voltage as the switching circuit is away from the position to which the rectified voltage Vrec is applied.

Each of the switching circuits 31 to 33 may include a comparator 36 and a switching element, and the switching element may be implemented with an NMOS transistor 37.

Each of the comparators 36 of the switching circuits 31 to 33 has a positive input terminal (+) configured to receive a reference voltage, a negative input terminal (−) configured to receive a sensing voltage, and an output terminal configured to output a comparison result between the reference voltage and the sensing voltage.

The NMOS transistors 37 of the respective switching circuits 31 to 33 form a current path and perform an operation for controlling a current flow of the current path, according to outputs of the comparators 36, applied to the gates thereof.

Figure 4:
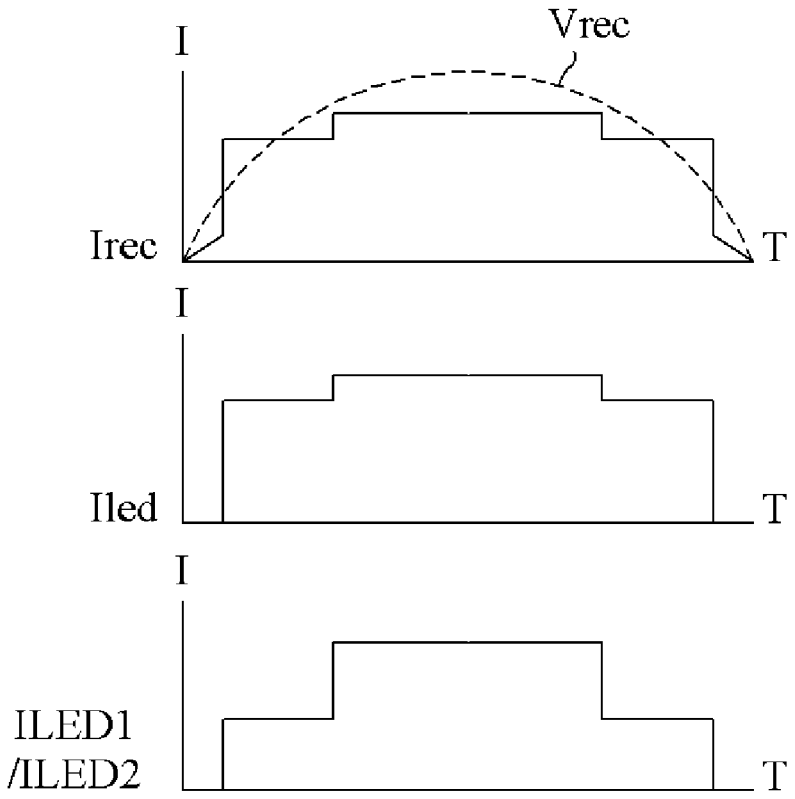
FIG. 4 is a waveform diagram illustrating an operation of the LED lighting apparatus according to the embodiment of FIG. 1, under the supposition that capacitors C1 and C2 are not installed in the LED groups.

The operation of the LED lighting apparatus according to the present embodiment will be described with reference to FIG. 4. FIG. 4 is a waveform diagram illustrating the operation of the LED lighting apparatus, with the capacitors C1 and C2 removed from the embodiment of FIG. 1. For convenience of description, the operation of the embodiment from which the capacitors C1 and C2 are removed will be described.

In FIG. 4, Irec represents an input current outputted from the rectifier circuit 200, Iled represents a current used for light emission, ILED1 represents a current flowing through the LED group LED1, and ILED2 represents a current flowing through the LED group LED2.

When the dimmer 100 provides a full-angle AC voltage to the rectifier circuit 200, the rectified voltage Vrec has a waveform that rises and falls by the half cycle of the AC voltage as illustrated in FIG. 4.

The rectified voltage Vrec in one cycle rises from the lowest level through the first to third levels to the peak level, and falls from the peak level through the third to first levels to the lowest level.

As described above, the first-level rectified voltage Vrec may be defined as a level at which a discharge path can be formed in the channel unit 500, the second-level rectified voltage Vrec may be defined as a level at which each of the LED groups LED1 and LED2 can emit light, and the third-level rectified voltage Vrec may be defined as a level at which the LED groups LED1 and LED2 connected in series can emit light.

When the rectified voltage Vrec is in the initial state (lowest level), all of the switching circuits 31 to 33 of the driver 300 are maintained in an on-state, because the reference voltages VREF1 to VREF3 applied to the positive input terminals (+) of the comparators 36 are higher than the sensing voltage applied to the negative input terminals (−) of the comparators 36. At this time, the LED groups LED1 and LED2 are maintained in an off state.

When the rectified voltage Vrec rises to reach the first level, the first level is applied across the Zener diode ZD of the channel unit 500. As a result, the Zener diode ZD is turned on.

The first-level rectified voltage Vrec is not enough to turn on the LED groups LED1 and LED2. Therefore, the input current outputted from the rectifier circuit 200 is discharged through the discharge path of the channel unit 500 and the turned-on switching circuit 31 of the driver 300.

While the rectified voltage Vrec rises from the first level to the second level, the discharge path of the channel unit 500 is maintained, and the input current Irec outputted from the rectifier circuit 200 is discharged through the channel unit 500 and the switching circuit 31 of the driver 300. The input current caused by the rectified voltage Vrec lower than the second level may be sensed by the sensing resistor Rs. However, since the sensing voltage at this time is lower than the reference voltages VREF1 to VREF3, all of the switching circuits 31 to 33 of the driver 300 are maintained in an on-state.

Then, when the rectified voltage Vrec reaches the second level, the second-level rectified voltage Vrec is applied across the LED groups LED1 and LED2. At this time, the LED group LED2 receives the rectified voltage Vrec of the rectifier circuit 200 through the balancing circuit 400 which provides a balancing path.

The LED groups LED1 and LED2 emit light using the second-level rectified voltage Vrec applied thereacross, the current ILED1 of the LED group LED1 flows through the turned-on switching circuit 32 of the driver 300, and the current ILED2 of the LED group LED2 flows through the turned-on switching circuit 33 of the driver 300.

At this time, the Zener diode ZD of the channel unit 500 can also maintain an on-state, as the second-level rectified voltage Vrec is applied across the Zener diode ZD. However, a current flow through the channel unit 500 is blocked by a turn-off of the switching circuit 31 of the driver 300.

More specifically, the input current Irec is increased in response to the second-level rectified voltage Vrec, the sensing resistor Rs provides a sensing voltage having a level proportional to the increased input current Irec, and the switching circuit 31 of the driver 300 is turned off because the sensing voltage applied to the negative input terminal (−) of the comparator 36 is higher than the reference voltage VREF1 applied to the positive input terminal (+) of the comparator 36.

Then, when the rectified voltage Vrec rises from the second level to less than the third level, the switching circuit 32 of the driver 300 regulates the current ILED1 flowing through the LED group LED1 using the sensing voltage of the sensing resistor Rs, while maintaining the on-state. At this time, the balancing circuit 400 regulates the current ILED2 flowing to the LED group LED2 using the balancing voltage of the balancing resistor Rb, while maintaining the on-state of the balancing path.

As a result, while the rectified voltage Vrec rises from the second level to less than the third level, the current ILED1 flowing through the switching circuit 32 of the driver 300 in response to the light emission of the LED group LED1 and the current ILED2 flowing through the first transistor Q1 of the balancing circuit 400, the balancing resistor Rb and the switching circuit 33 of the driver 300 in response to the light emission of the LED group LED2 are retained as a constant current.

At this time, the current level regulated by the balancing circuit 400 and the current level regulated by the switching circuit 32 of the driver 300 may be set to the same level. In this case, the level of the constant current corresponding to the light emission of the LED group LED1 may be equal to the level of the constant current corresponding to the light emission of the LED group LED2.

Then, when the rectified voltage Vrec reaches the third level, the first transistor Q1 of the balancing circuit 400 is turned off by the lowered gate voltage. As a result, the balancing path is blocked.

Therefore, the third-level rectified voltage Vrec is applied across the LED groups LED1 and LED2 connected in series through the diodes D1 and D2 and the balancing resistor Rb, and the LED groups LED1 and LED2 maintain the light emitting state using the third-level rectified voltage Vrec applied thereacross.

The input current Irec is increased in response to the third-level rectified voltage Vrec, and the amount of current caused by the light emission of the LED groups LED1 and LED2 connected in series becomes larger than the amount of current corresponding to the second-level rectified voltage Vrec. FIG. 4 shows that the amount of current caused by the light emission of the LED groups LED1 and LED2 connected in series to each other in response to the third-level rectified voltage Vrec is larger than the amounts of the currents ILED1 and ILED2 of the LED groups LED1 and LED2 connected in parallel to each other in response to the second-level rectified voltage Vrec. At this time, the currents flowing through the LED groups LED1 and LED2 in response to the third-level rectified voltage Vrec have the same amount.

In response to a change of the rectified voltage Vrec equal to or higher than the third level, the switching circuit 33 of the driver 300 regulates a current using the sensing voltage of the sensing resistor Rs while maintaining the on-state.

As a result, while the rectified voltage Vrec rises from the third level to the peak level and then falls to the third level, the current caused by the light emission of the LED groups LED1 and LED2 connected in series to each other is retained as a constant current.

Then, when the rectified voltage Vrec falls below the third level to the second level or more, the LED groups LED1 and LED2 are connected in parallel to the rectifier circuit 200 and maintain the light emission. At this time, the switching circuit 32 of the driver 300 is turned on to provide a current path corresponding to the light emission.

Then, when the rectified voltage Vrec falls below the second level, the LED groups LED1 and LED2 are turned off. At this time, the switching circuit 31 of the driver 300 is turned on to provide a current path for discharging a current through the discharge path of the channel unit 500.

In the present embodiment, the LED groups emit light at the same voltage, and maintain the light emission using the same current. Therefore, the LED lighting apparatus according to the present embodiment can remove a difference in illumination between the LED groups.

Furthermore, the entire LED groups may be connected in parallel or series to maintain the light emitting state. Therefore, the LED lighting apparatus according to the present embodiment can improve the usage rate of the entire LED diodes and the lifetimes of the LEDs, compared to the configuration in which the LED groups sequentially emit light.

Furthermore, it is possible to prevent a part of the LEDs from emitting weak light when the rectified voltage is controlled to a level for turn-off by the dimmer due to the formation of the discharge path in the channel unit.

The operation of the LED lighting apparatus according to the present embodiment has been described with the capacitors C1 and C2 removed from the embodiment of FIG. 1.

When the capacitors C1 and C2 are installed in parallel to the LED groups LED1 and LED2, respectively, as illustrated in FIG. 1, the capacitors C1 and C2 may be charged and discharged by the voltages supplied to the LED groups LED1 and LED2.

That is, the capacitors C1 and C2 are charged when the voltages applied to the LED groups LED1 and LED2 rise, and discharged when the voltages applied to the LED groups LED1 and LED2 are lower than the charging voltage.

The LED lighting apparatus according to the embodiment of the present invention can remove uneven illumination through the operation characteristic of the dimmer 100, and reduce flicker through the charging and discharging operations of the capacitors C1 and C2.

Furthermore, since the current caused by the charging voltage can be supplied to the LED groups LED1 and LED2 even in a section where the rectified voltage Vrec falls, the light emitting states of the LED groups LED1 and LED2 can be maintained. Therefore, it is possible to reduce flicker which may occur according to periodic changes of the rectified voltage Vrec.

Figure 5:
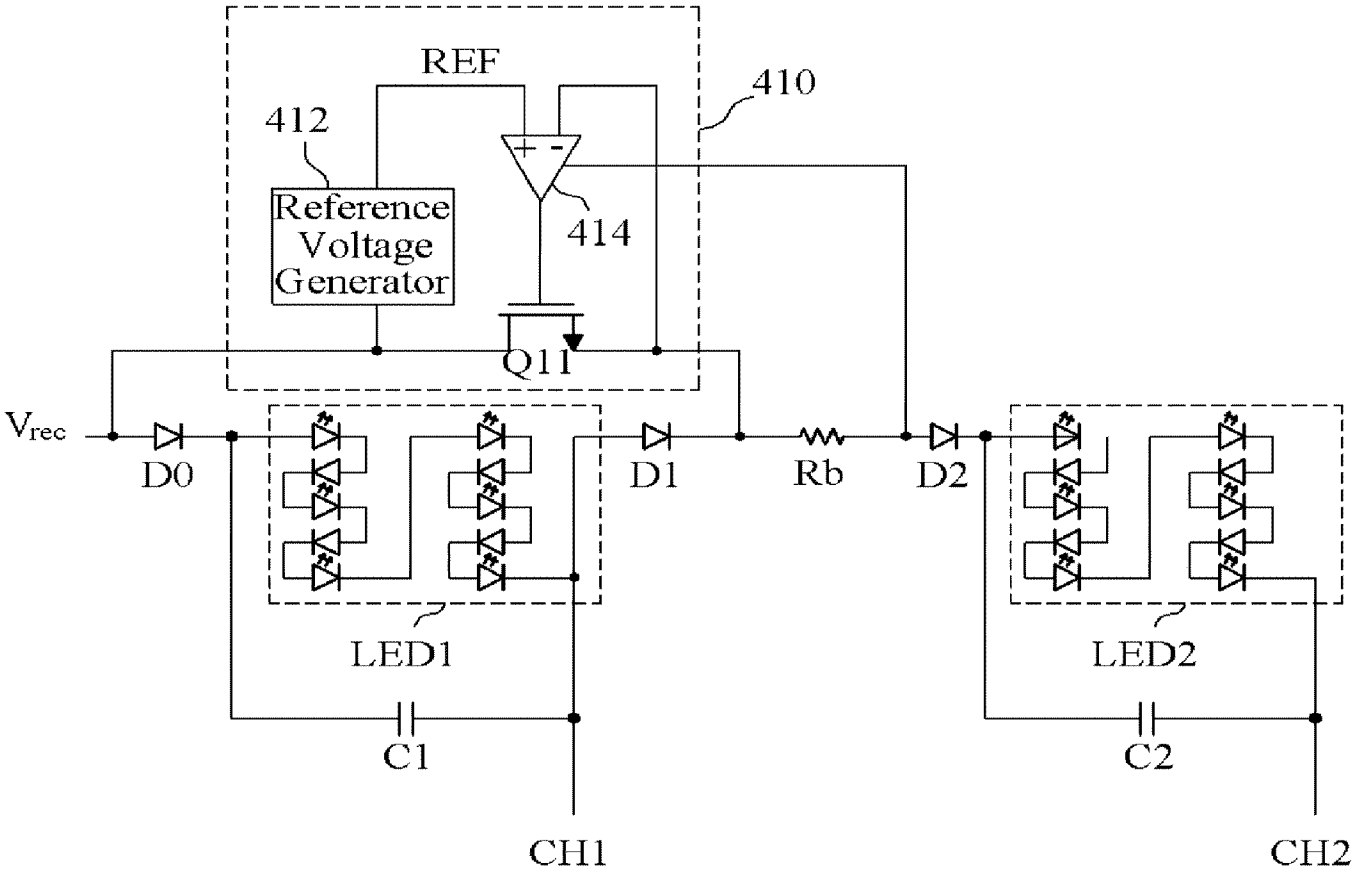
FIG. 5 is a circuit diagram illustrating an LED lighting apparatus according to a modification of the present invention.

The balancing circuit of FIG. 1 may be modified as illustrated in FIG. 5.

In the embodiment of FIG. 5, the other parts excluding the balancing circuit are configured and operated in the same manner as those of FIG. 2. Thus, the duplicated descriptions thereof are omitted herein. In FIG. 5, the balancing circuit is represented by reference numeral 410 and distinguished from that of FIGS. 1 and 2.

In FIG. 5, the balancing circuit 410 includes a transistor Q11, a reference voltage generation unit 412 and a comparator 414.

The transistor Q11 is installed between the rectifier circuit 200 and the balancing resistor Rb, and an operation of forming the balancing path is controlled by an output of the comparator 414.

The reference voltage generation unit 412 receives the rectified voltage Vrec outputted from the rectifier circuit 200, generates a reference voltage REF having a preset level, and applies the reference voltage REF to a positive input terminal (+) of the comparator 414. For this operation, the reference voltage generation unit 412 may be implemented with a constant voltage source.

The comparator 414 has the positive input terminal (+), a negative input terminal (−), an output terminal and a driving terminal. The positive input terminal (+) of the comparator 414 is configured to receive the reference voltage REF of the reference voltage generation unit 412, the negative input terminal (−) is connected to an output terminal of the transistor Q11, that is, a node between the diode D1 and the balancing resistor Rb, the output terminal is connected to the gate of the transistor Q11, and the driving terminal is connected to a node between the balancing resistor Rb and the diode D2.

According to the above-described configuration, a balancing voltage applied across the balancing resistor Rb is applied to the negative input terminal (−) of the comparator 414.

That is, the comparator 414 compares the reference voltage REF and the balancing voltage of the balancing resistor Rb, and controls the transistor Q11 according to the comparison result, thereby controlling the formation of the balancing path through the transistor Q11 and the regulation of the current flowing through the balancing path.

More specifically, the reference voltage generation unit 412 may provide the reference voltage REF having a level which is higher than the balancing voltage formed across the balancing resistor Rb before the rectified voltage Vrec reaches the third level and lower than the balancing voltage formed across the balancing resistor Rb when the rectified voltage Vrec reaches the third level.

When the rectified voltage Vrec is lower than the second level, no current flows through the balancing resistor Rb. Therefore, the balancing voltage is not formed. In this case, since the voltage of the positive input terminal (+) is high, the comparator 414 outputs a high-level voltage as a comparison result to turn on the transistor Q11.

Then, when the rectified voltage Vrec rises over the second level to less than the third level, the balancing voltage of the balancing resistor Rb rises in response to the increased current. In this case, since the voltage of the positive input terminal (+) is higher than the balancing voltage of the negative input terminal (−), the comparator 414 also outputs a high-level voltage as a comparison result to maintain the on-state of the transistor Q11. When the balancing voltage rises, the level of the voltage applied to the gate of the transistor Q11 from the comparator 414 falls. That is, while the rectified voltage Vrec rises over the second level to less than the third level, the comparator 414 regulates the current flowing through the transistor Q11 such that the amount of current flowing through the transistor Q11 is constantly maintained.

Then, when the rectified voltage Vrec rises over the third level, the balancing voltage of the balancing resistor Rb is formed at a higher level than the reference voltage REF. In this case, the comparator 414 outputs a low-level voltage as a comparison result, and the transistor Q11 is turned off by the lowered gate voltage. That is, the balancing path by the balancing circuit 410 is blocked.

In the present embodiment to which the balancing circuit 410 of FIG. 5 is applied, the LED groups LED1 and LED2 also emit light at the same voltage, and maintain the light emission using the same current. Therefore, the LED lighting apparatus can remove a difference in illumination between the LED groups.

Furthermore, the LED groups LED1 and LED2 may be connected in parallel or series to maintain the light emitting state. Therefore, the usage rate of the entire LEDs and the lifetimes of the LEDs can be improved.

As described above, the LED lighting apparatus according to the present embodiment can provide various effects, which makes it possible to improve the reliability.

According to the embodiments of the present invention, the LED groups can emit light at the same voltage, and retain the light emission at the same amount of current. Therefore, the LED lighting apparatus can reduce a difference in illumination between the LED groups, and improve the usage rates of the LEDs included in the LED groups.

Furthermore, when the rectified voltage is controlled to the level for turn-off by the dimmer, the LED lighting apparatus can block a holding current flowing to the LEDs, thereby preventing a part of the LEDs from emitting weak light through the holding current.

Furthermore, the LED lighting apparatus can uniformize uneven illumination which may occur depending on whether the dimmer is employed. As a result, the LED lighting apparatus can realize uniform dimming for light emission of the LED groups, and reduce flicker using the charge and discharge of the capacitors.

While various embodiments have been described above, it will be understood to those skilled in the art that the embodiments described are by way of example only. Accordingly, the disclosure described herein should not be limited based on the described embodiments.

What is claimed is:

1. An LED lighting apparatus comprising:

a rectifier circuit configured to output a rectified voltage;

a channel unit configured to provide a discharge current to an output terminal of the rectifier circuit when the rectified voltage is equal to or higher than a first level;

a first LED group connected to the rectifier circuit, and configured to emit light in response to the rectified voltage equal to or more than a second level which is higher than the first level;

a balancing resistor connected to an output terminal of the first LED group;

a balancing circuit configured to form a balancing path between the rectifier circuit and the balancing resistor and perform first regulation on a current of the balancing path, in response to the rectified voltage less than a third level which is higher than the second level;

a second LED group connected to the balancing resistor, and configured to emit light in response to the rectified voltage applied through any one of the balancing path and the first LED group;

a driver configured to selectively provide a current path for the turned-on first and second LED groups and the discharge path of the channel unit by comparing a sensing voltage and an internal reference voltage; and a sensing resistor configured to sense a driving current outputted from the driver through the current path, and provide the sensing voltage.

2. The LED lighting apparatus of claim 1, further comprising a dimmer configured to provide a phase angle-controlled AC voltage to the rectifier circuit, wherein the rectifier circuit outputs the rectified voltage corresponding to the phase angle-controlled AC voltage, and the channel unit is connected in parallel to the LED groups.

3. The LED lighting apparatus of claim 1, wherein the channel unit comprises a constant voltage source configured to form a constant voltage having the first level, and provides the discharge path when the rectified voltage is equal to or more than the first level.

4. The LED lighting apparatus of claim 1, wherein the first and second LED groups emit light when a voltage equal to or more than the second level is applied across the first and second LED groups.

5. The LED lighting apparatus of claim 1, further comprising a first capacitor connected in parallel to the first LED group and a second capacitor connected in parallel to the second LED group.

6. The LED lighting apparatus of claim 1, wherein the balancing circuit provides a current to the second LED group in response to the rectified voltage equal to or more than the second level and less than the third level, the current having the same amount as a current flowing through the first LED group.

7. The LED lighting apparatus of claim 6, wherein the balancing circuit decides the amount of current regulated by the first regulation according to a resistance value of the balancing resistor, and the resistance value of the balancing resistor is set to such an extent that the amount of current regulated by the first regulation of the balancing circuit is equal to the amount of current regulated by second regulation of the driver, which is performed on a current outputted from the second LED group in response to the rectified voltage equal to or more than the second level and less than the third level.

8. The LED lighting apparatus of claim 1, wherein the balancing circuit comprises:

a first transistor installed between the rectifier circuit and the balancing resistor, and configured to form the balancing path; and a second transistor configured to control the amount of current flowing through the first transistor in response to a change of the balancing voltage, wherein the first transistor forms the balancing path and performs the first regulation on the current flowing through the balancing path in response to the balancing voltage less than a predetermined level, and blocks the balancing path in response to the balancing voltage equal to or more than the predetermined level.

9. The LED lighting apparatus of claim 1, wherein the balancing circuit comprises:

a transistor installed between the rectifier circuit and the balancing resistor, and configured to form the balancing path;

a reference voltage generation unit configured to generate a reference voltage in response to the rectified voltage; and a comparator configured to compare the reference voltage and a balancing voltage of the balancing resistor, and control the formation of the balancing path and the regulation on the current flowing through the balancing path by controlling the transistor according to the comparison result.

10. The LED lighting apparatus of claim 1, wherein the driver comprises:

a reference voltage supply unit configured to provide a first reference voltage, a second reference voltage higher than the first reference voltage, and a third reference voltage higher than the second reference voltage;

first to third comparison units configured to compare the sensing voltage to the first to third reference voltages, respectively; and first to third switching elements connected to the discharge path, the first LED group and the second LED group, respectively, configured to form first to third current paths according to the comparison results of the first to third comparison units, and connected to the sensing resistor in common.

11. The LED lighting apparatus of claim 1, wherein the driver performs second regulation on a current outputted from the first LED group in response to the rectified voltage equal to or more than the second level and less than the third level, and performs third regulation on a current outputted from the second LED group in response to the rectified voltage equal to or more than the third level.

12. The LED lighting apparatus of claim 11, wherein the driver performs the third regulation to regulate a current having a higher level than the currents regulated by the first and second regulations.

13. The LED lighting apparatus of claim 1, wherein in response to the rectified voltage equal to or more than the second level and less than the third level, the first and second LED groups receive an input current in parallel to each other through the formation of the balancing path, the driver blocks a first current path for the discharge path, provides a second current path corresponding to light emission of the first LED group and a third current path corresponding to light emission of the second LED group in parallel to each other, and controls the amount of current in the second current path through second regulation based on the comparison between the sensing voltage and the reference voltage, and the amount of current in the third current path is controlled by the first regulation of the balancing circuit.

14. The LED lighting apparatus of claim 1, wherein in response to the rectified voltage equal to or more than the third level, the rectified voltage is applied across the first and second LED groups connected in series through the balancing resistor by a turn-off of the balancing path, and the driver provides a third current path corresponding to light emission of the first and second LED groups connected in series to an output terminal of the second LED group, and controls the amount of current in the third current path through third regulation based on the comparison between the sensing voltage and the reference voltage.

15. The LED lighting apparatus of claim 1, further comprising first and second diodes installed at input terminals of the first and second LED groups, respectively.

16. An LED lighting apparatus comprising:

a dimmer configured to output a phase angle-controlled AC voltage;

a rectifier circuit configured to output a rectified voltage in response to the AC voltage;

a channel unit configured to provide a discharge path for a holding current of the dimmer to an output terminal of the rectifier circuit when the rectified voltage is equal to or more than a first level;

first and second LED groups configured to receive the rectified voltage, connected in series to emit light when the rectified voltage is equal to or more than a third level in a one-cycle change of the rectified voltage, and connected in parallel to emit light when the rectified voltage is equal to or more than the second level and less than the third level, wherein the second level is higher than the first level, and the third level is higher than the second level;

a balancing resistor installed between the first and second LED groups;

a balancing circuit configured to control formation of a balancing path through a balancing voltage of the balancing resistor, provide the balancing path for transferring the rectified voltage to the second LED group connected in parallel to the first LED group through the balancing resistor in response to the rectified voltage equal to or more than the second level and less than the third level, and perform first regulation on a current of the balancing path;

a driver configured to selectively provide a current path corresponding to light emission of the first and second LED groups and the discharge path of the channel unit by comparing a sensing voltage and an internal reference voltage; and a sensing resistor configured to sense a driving current outputted from the driver through the current path, and provide the sensing voltage.

17. The LED lighting apparatus of claim 16, wherein the balancing circuit performs the first regulation in response to the rectified voltage equal to or more than the second level and less than the third level, such that the same amount of current as the first LED group flows to the second LED group.

18. The LED lighting apparatus of claim 16, wherein the balancing circuit comprises:

a first transistor installed between the rectifier circuit and the balancing resistor, and configured to form the balancing path; and a second transistor configured to control the amount of current flowing through the first transistor in response to a change of the balancing voltage, wherein the first transistor forms the balancing path and performs the first regulation on the current flowing through the balancing path in response to the balancing voltage less than a predetermined level, and blocks the balancing path in response to the balancing voltage equal to or more than the predetermined level.

19. The LED lighting apparatus of claim 16, wherein the balancing circuit comprises:

a transistor installed between the rectifier circuit and the balancing resistor, and configured to form the balancing path;

a reference voltage generation unit configured to generate a reference voltage in response to the rectified voltage; and a comparator configured to compare the reference voltage and the balancing voltage of the balancing resistor, and control the formation of the balancing path and the regulation on the current flowing through the balancing path by controlling the transistor according to the comparison result.

20. The LED lighting apparatus of claim 16, wherein the driver comprises:

a reference voltage supply unit configured to provide a first reference voltage, a second reference voltage higher than the first reference voltage, and a third reference voltage higher than the second reference voltage;

first to third comparison units configured to compare the sensing voltage to the first to third reference voltages, respectively; and first to third switching elements connected to the discharge path, the first LED group and the second LED group, respectively, configured to form first to third current paths according to the comparison results of the first to third comparison units, and connected to the sensing resistor in common, wherein the driver performs second regulation on a current outputted from the first LED group in response to the rectified voltage equal to or more than the second level and less than the third level, and performs third regulation on a current outputted from the second LED group in response to the rectified voltage equal to or more than the third level.

* * * * *